US008199045B1

(12) United States Patent
Rodgers et al.

(10) Patent No.: US 8,199,045 B1
(45) Date of Patent: Jun. 12, 2012

(54) NICKEL NANOSTRAND ESD/CONDUCTIVE COATING OR COMPOSITE

(75) Inventors: Steven R. Rodgers, South Jordan, UT (US); Randall W. Nish, Provo, UT (US); Jason Jon Vogel, Sandy, UT (US)

(73) Assignee: Exelis Inc., McLean, VA (US)

( * ) Notice: Subject to any disclaimer, the term of this patent is extended or adjusted under 35 U.S.C. 154(b) by 0 days.

(21) Appl. No.: 12/758,188

(22) Filed: Apr. 12, 2010

Related U.S. Application Data

(60) Provisional application No. 61/168,743, filed on Apr. 13, 2009.

(51) Int. Cl.
*H01Q 17/00* (2006.01)

(52) U.S. Cl. ..... 342/1; 342/4

(58) Field of Classification Search ..... 342/1–12
See application file for complete search history.

(56) References Cited

U.S. PATENT DOCUMENTS

| | | | | |
|---|---|---|---|---|
| 5,130,204 | A | 7/1992 | Jenkin | |
| 5,951,791 | A | 9/1999 | Bell et al. | |
| 5,967,400 | A | 10/1999 | Bell et al. | |
| 7,846,295 | B1 * | 12/2010 | Medoff | 162/50 |
| 2007/0125998 | A1 * | 6/2007 | Bunce et al. | 257/40 |
| 2008/0087762 | A1 * | 4/2008 | Holloman et al. | 244/30 |
| 2008/0128688 | A1 * | 6/2008 | Pan et al. | 257/40 |
| 2009/0117269 | A1 * | 5/2009 | Hansen et al. | 427/212 |
| 2009/0197089 | A1 * | 8/2009 | Klippert | 428/413 |
| 2009/0202764 | A1 * | 8/2009 | Tonon et al. | 428/36.3 |
| 2010/0209690 | A1 * | 8/2010 | Sang et al. | 428/221 |
| 2010/0282668 | A1 * | 11/2010 | Cooper et al. | 210/500.21 |

OTHER PUBLICATIONS

Behr non-Skid Floor Finish Additive, No. 970, Rev. Oct. 2008.
Behr 1-Part Epoxy Acrylic Concreet & Garage Floor Paint, Rev. Oct. 2008.
Popular Science, Stealth, , Jul. 1988; pp. 46-51; 94-95.
3M; Vehicle Wrap; Top for a Perfect Wrap Tips; pp. 1-4.
Web Page- www.Adv-polymer.com.com/about/silox.asp; printed Apr. 5, 2010; Siloxirane Polymer from Advanced Polymer Coatings.

* cited by examiner

*Primary Examiner* — Timothy A Brainard
(74) *Attorney, Agent, or Firm* — Thorpe North & Western LLP

(57) ABSTRACT

A polymer-based coating includes nickel nanostrands dispersed within a polymer, and a pigment that is conductive or semi-conductive dispersed in the polymer.

23 Claims, 1 Drawing Sheet

NICKEL NANOSTRAND ESD/CONDUCTIVE COATING OR COMPOSITE

PRIORITY CLAIM

Priority is claimed to copending U.S. Provisional Patent Application Ser. No. 61/168,743, filed Apr. 13, 2009, which is hereby incorporated herein by reference in its entirety.

BACKGROUND

1. Field of the Invention

The present invention relates generally to electrostatic discharge (ESD) and/or conductive coatings or composites with nickel nanostrands.

2. Related Art

Nickel nanostrands have been mixed into Siloxirane™ polymer based paint, applied to a mandrel, and wet-wound with graphite fiber and resin composite to form a composite material with integral electrostatic discharge (ESD) protection. Nickel nanostrands are self assembled three dimensionally branched and interconnected high aspect ratio sub-micron chains of pure nickel that form a volumetrically continuous network of nano- and micro-level Faraday cages. Nickel nanostrands are available from Conductive Composites Company, LLC, (aka Metal Matrix Composites) of Midway, Utah. For example, see U.S. Pat. Nos. 5,967,400; 5,951,791 and 5,130,204; and US Patent Application No. 2009/0117269. Siloxirane™ polymer coatings are available from Advanced Polymer Coatings of Avon, Ohio, and are reported to have good chemical and abrasion resistance.

SUMMARY OF THE INVENTION

It has been recognized that it would be advantageous to develop improved or enhanced stealth or reduced radar signature structures or coatings; and electrostatic discharge (ESD), chemical resistant coating to metals, composites, plastics, etc.

The invention provides a low radar cross-section structure with a substrate configured to have a low radar cross-section or signature, including a radar absorbing material, a multilayer laminate, a rubber material, alternating layers of dielectric material, a layer of hexagonal honeycomb tubes, a radar ablative paint, two layers of ferrite material separated by a dielectric, or combinations thereof. The structure includes a polymer-based nickel nanostrand coating in combination with the substrate. The coating including nickel nanostrands dispersed within a polymer.

In addition, the invention provides a polymer-based coating with nickel nanostrands dispersed within a polymer. A pigment that is conductive or semi-conductive is dispersed in the polymer.

In addition, the invention provides a field configurable coating kit with a first "A" component of nickel nanostrands pre-dispersed in a resin with silicon; and a second "B" component or catalyst separate from the first "A" component and combinable with the first "A" component immediately prior to use. One or more additives can include a biocide, a pigment, an abrasion resistant material, grit, or combinations thereof.

In addition, the invention provides an electromagnetic isolation (EMI) wrap in combination with a vehicle having a plastic sheet or film wrapped about the vehicle. Nanostrands are dispersed in a polymer applied to a surface of the plastic sheet or film.

Furthermore, the invention provides a method of powder coating a surface, comprising: obtaining a dry powder paint doped with nanostrands; oppositely charging the surface and the nanostrand doped powder paint with respect to one another; applying the nanostrand doped powder paint to the surface; and curing the paint in an oven causing the paint to mold into a solid layer.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term or phrase "polymer-based nickel nanostrand coating" is used broadly herein to refer a polymer-based coating or paint with nickel nanostrands therein. The nickel nanostrands can be dispersed within the polymer.

The polymer-based coating can include a polymer. In addition, the coating or polymer can include a silicon based resin. For example, such a coating or paint can be obtained from Advanced Polymer Coatings of Avon, Ohio, which contains Siloxirane™ polymer.

Nickel nanostrands are self assembled three dimensionally branched and interconnected high aspect ratio sub-micron chains of pure nickel that form a volumetrically continuous network of nano- and micro-level Faraday cages. Nickel nanostrands are available from Conductive Composites Company, LLC, (aka Metal Matrix Composites) of Midway, Utah.

DESCRIPTION

The present invention presents various embodiments of a polymer-based (such as Siloxirane™) nickel nanostrand coating. The coating can be used as part of a stealth or reduced radar signature program. Military vehicles, such as military aircraft, or even groundcraft or watercraft, are an example of one application of the present invention.

Figure 1A:
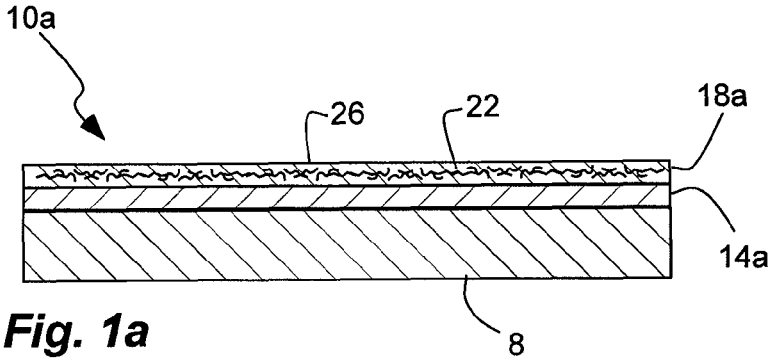
FIG. 1*a* is a schematic cross-sectional side view of a low radar cross-section structure and/or vehicle in accordance with an embodiment of the present invention.

Referring to FIG. 1*a*, a low radar cross-section structure, indicated generally at 10*a*, is shown in accordance with an exemplary embodiment of the present invention. The structure 10*a* can be disposed on or can form part of a vehicle 8, such as an aircraft. The structure 10*a* can include a substrate 14*a* having a low radar cross-section or signature. A polymer-based nickel nanostrand coating 18*a* is combined with the substrate 14. For example, referring to FIG. 1*a*, the polymer-based nickel nanostrand coating 18*a* can be applied over or on the substrate 14*a* having the low radar cross-section or signature. As described above, the coating 18*a* can includes nickel nanostrands, represented by 22, dispersed within a polymer, represented by 26. The polymer or resin can include a silicon based resin. It is believed that the use of such a polymer-based nickel nanostrand coating or layer can help reduce visibility to conventional radar systems by helping to absorb or disperse the radar signal. The substrate 14*a* can be or can include a radar absorbing material, a multi-layer laminate, a rubber material, alternating layers of dielectric material, a layer of hexagonal honeycomb tubes, a radar ablative paint, two layers of ferrite material separated by a dielectric, or combinations thereof. In addition, the coating 18*a* can form an exterior of the structure 10*a* or vehicle 8. The coating 18*a* can form a protective coating to the structure or vehicle, with the polymer of the coating providing good chemical and abrasion resistance. Furthermore, in addition to enhancing or supplementing the absorption or dispersion of radar signals, the polymer-based nickel nanostrand coating can also provide electrostatic discharge (ESD) shielding.

In another aspect, the coating 18*a* can include a pigment that is conductive or semi-conductive. For example, the pigment can include carbon black, silver, iron oxide, flake mica titania, or combinations thereof. The pigment that is conductive or semi-conductive can provide both a desired coloring, for camouflage or the like, and supplementing or enhancing the conductivity provided by the nickel nanostrands.

In another aspect, the coating 18*a* can include an abrasion resistant material. For example, the abrasion resistant material can include silicon carbide, para-aramid synthetic fiber flock, or combinations thereof. The abrasion resistant material can further supplement or enhance the abrasion resistance of the polymer. In addition, such a coating and/or structure can be applied to helicopter blades, or to aircraft exterior structure near rotor blade, engines, landing gear, etc.

In another aspect, the coating 18*a* can include a biocide. For example, the biocide can include copper, silver, capsaicin, or combinations thereof. Such a biocide can be useful for structures or vehicles, such as watercraft or ship hulls, subject to marine conditions to provide a biological resistive coating to resist the attachment and build-up of biological organisms, etc.

In another aspect, the coating can further include a grit. Such a coating can be applied to walking and gripping surfaces to provide traction. For example, such a coating can be applied to ship decks, aircraft wings and sponsons to provide a tough, corrosion-resistant layer with traction. Such a coating can also be applied to shop floors or cleanroom floors.

Figure 1B:
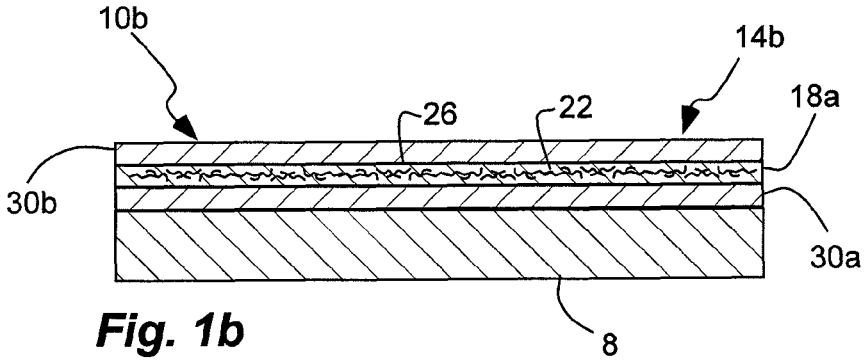
FIG. 1*b* is a schematic cross-sectional side view of another low radar cross-section structure and/or vehicle in accordance with another embodiment of the present invention.

Referring to FIG. 1*b*, a structure 10*b* can have the polymer-based nickel nanostrand coating 18*a* disposed within the substrate 14*b*. The substrate 14*b* can be a multi-layered substrate or laminate with various different or similar layers, represented by layers 30*a* and 30*b*. The coating 18*a* can be disposed between the layers 30*a* and 30*b* of the substrate 14*b*. For example, the coating 18*a* can be applied to a first layer 30*a*, and a second layer 30*b* can be applied over the coating and first layer. The substrate 14*b* can have more than two layers; and more than one coating can be disposed between the various layers. As described above, the substrate 14*b*, or layers thereof, can be or can include a radar absorbing material, a multi-layer laminate, a rubber material, alternating layers of dielectric material, a layer of hexagonal honeycomb tubes, a radar ablative paint, two layers of ferrite material separated by a dielectric, or combinations thereof. As described above, the coating can include pigment, abrasion resistant material, and/or biocide.

In addition, a polymer-based (such as Siloxirane™) nickel nanostrand coating can provide an electrostatic discharge (ESD), chemical resistant coating to metals, composites, plastics, etc. Such a coating can provide a protective coating for metals requiring a corrosion barrier but also needing ESD protection, such as marine vessels, structures in high salt environments, etc. Such a coating can provide ESD protection to non-conductive composite and plastic tanks, particularly chemical tanks with a risk of explosive hazard. Such a coating can be applied to interior of tubes or pipes to avoid static buildup, as material flows through the tube, especially with highly abrasive materials such as mineral slurries. Such a coating can be applied to composite antennas for electromagnetic (EM) reflectivity, especially in high rain or sand abrasive environments. Such a coating can be applied to electronic housing and components to provide ESD and electromagnetic interference (EMI) protection. Such a coating can be applied to electronic assembly work stations reducing the need for grounding straps.

The polymer-based coating includes a polymer, such as a silicon based resin. Non-limiting examples of suitable silicon based resins can include silicone resins (e.g. polymers containing O—Si—O repeating units), and derivatives thereof. Silicone resins can include, but are not limited to, siloxanes such as polydimethylsiloxane, and epoxy siloxanes. In one specific aspect, the silicon based resin can be a siloxane having epoxy (when not yet cured) end groups and ether crosslinking groups (e.g. commercially available as Siloxirane™). For example, a Siloxirane™ polymer coating or paint available from Advanced Polymer Coatings of Avon, Ohio, can be used. The coating includes nickel nanostrands dispersed within the polymer. Such nickel nanostrands can be obtained from Conductive Composites Company, LLC, (aka Metal Matrix Composites) of Midway, Utah. These nanostrands can have varying diameter, typically from about 50 nm to about 2 μm, although about 500 nm can be used. Aspect ratios (e.g. length to diameter) can often range from 50:1 to about 500:1, although other ratios can be obtained. The nickel nanostrands can be dispersed within the polymer at a concentration sufficient to provide the desired electrical conductivity. This concentration can vary depending on the specific materials, but can be from about 0.5 wt % to about 20 wt % of the coating composition and in some cases from about 1 wt % to about 10 wt %. The coating includes a pigment that is conductive or semi-conductive dispersed in the polymer. For example, the pigment can include carbon black, silver, iron oxide, flake mica, titania, or combinations thereof. The pigment can provide both a desired coloring, for camouflage or the like, and supplementing or enhancing the conductivity provided by the nickel nanostrands. As a general guideline, the pigment can be present from about 0.1 wt % to about 20 wt % of the coating, although other concentrations can also be suitable.

The coating can further include an abrasion resistant material dispersed in the polymer. For example, the abrasion resistant material can include silicon carbide, para-aramid synthetic fiber flock, or combinations thereof. The abrasion resistant material can further supplement or enhance the abrasion resistance of the polymer. Such a coating can be applied to helicopter blades, or to aircraft exterior structure near rotor blade, engines, landing gear, etc.

The coating can further include a biocide dispersed in the polymer. For example, the biocide can include copper, silver (e.g. in zeolite zirconium phosphate), capsaicin, triclosan, or combinations thereof. Such a coating can be useful for structures or vehicles, such as watercraft or ship hulls, subject to marine conditions to provide a biological resistive coating to resist the attachment and build-up of biological organisms, etc.

The coating can further include a grit. Such a coating can be applied to walking and gripping surfaces to provide traction. For example, such a coating can be applied to ship decks, aircraft wings and sponsons to provide a tough, corrosion-resistant layer with traction. Other additives can also be optionally included such as, but not limited to, IR absorbers (phthalocyanines, polymethines, etc), gloss enhancers, nanodots (e.g. Cd, Se, Au, etc.), and the like.

The coating can be provided in or as a coating kit, described in greater detail below. The kit can be a field configurable coating kit that can be utilized in field or onsite applications. The kit can include a first "A" component with the nickel nanostrands and the pigment pre-dispersed in a resin. A second "B" component or catalyst can be separate from the first "A" component and combinable with the first "A" component immediately prior to use. One or more additives can be included with the kit, such as a biocide, an abrasion resistant material, grit, or combinations thereof.

The coating can be provided on or applied to a plastic sheet or film, as described in greater detail below. The sheet or film can be conductive or semi-conductive. Such a sheet or film with the coating thereon can form a wrap that can be applied to a vehicle or the like.

Figure 2:
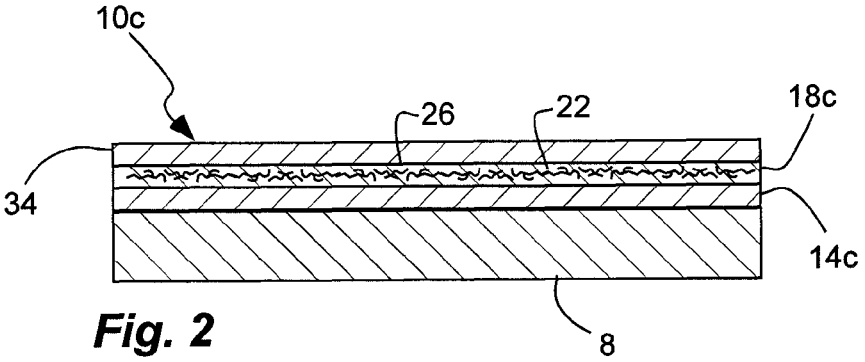
FIG. 2 is a schematic cross-sectional side view of a wrap in accordance with an embodiment of the present invention disposed on a vehicle.

Referring to FIG. 2, an electromagnetic isolation (EMI) wrap 10*c* can be disposed on a vehicle 8. The wrap 10*c* can include a plastic sheet or film 14*c*. The plastic sheet or film can be a cast vinyl film, such as 3M Controltac™ Wrap Film available from 3M. Furthermore, the sheet or film can be conductive or semi-conductive to supplement or enhance the nickel nanostrands. The polymer can include a pigment, as described above. A polymer 18*c* with nanostrands dispersed therein can be disposed on or applied to a surface of the plastic sheet or film. The plastic sheet or film can be wrapped about the vehicle. For example, the sheet or film can be applied to the vehicle with adhesive, such as 3M Comply™ Adhesive available from 3M. In addition, the sheet or film can be stretched and or heated to apply to the vehicle. Furthermore, an overlaminate 34 can be applied over the polymer with nanostrands, such as 3M Scotchcal™ Gloss Overlaminate or 3M Scotchcal™ Luster Overlaminate available from 3M. The electromagnetic isolation (EMI) wrap 10*c* can provide EMI shielding to an object or vehicle, and can be applied over the object or vehicle like a decal or appliqué. The nanostrands can be dispersed in a material, such as a polymer, and printed onto a film, such as with an inkjet printer. Alternatively, the nanostrands can be applied to the film as a coating. In another aspect, the film with the material (polymer) and nanostrands can be substantially transparent. Thus, the decal or appliqué can be applied on a window, windshield, canopy, etc. Such a decal or appliqué can be used to provide EMI shielding to rooms, compartments, deckhouses on ships, or entire buildings, or to provide a shielded (but visibly transparent) cover over windows, to military vehicles, such as over aircraft canopies, etc. Another variation is to ink the nanostrands on one layer and then laminate the film with other layers having different properties to create a multilayer laminate.

As indicated above, a field configurable coating kit can be provided. A first "A" component of nickel nanostrands is pre-dispersed in a resin with silicon. A second "B" component or catalyst is separate from the first "A" component and combinable with the first "A" component immediately prior to use. The kit can also include one or more additives, or "C" component, including a biocide, a pigment, an abrasion resistant material, grit, or combinations thereof. The additives can be combined with the "A" and "B" components prior to use.

A method for providing batch processing of a polymer-based nickel nanostrand coating (or "A" component thereof) in large, commercial quantities includes mixing a resin and a solvent to achieve a desired viscosity. Nickel nanostrands are then added in a desired amount and dispersed throughout the resin/solvent mixture, such as with a centrifuge or other high sheer mixing technique, to achieve the desired conductivity, viscosity, even dispersion or similar performance or processing parameters. The resin/solvent/nanostrand mixture is then screened; breaking up any clumps in preparation for spray gun application. In another aspect, the mixing, dispersing and screening can be accomplished automatically with an automated metering machine to measure (by volume and/or weight) the required components, an automated centrifuge to disperse the nanostrands, and an automated packager to screen and package the mixture. The pre-dispersed nanostrand mixture can constitute the "A" component and can be provided with a separate "B" component (or catalyst) to be mixed by the user. In another aspect, pre-configured formulations can be provided with predetermined viscosity and/or conductivity characteristics. In another aspect, custom formulations can be provided.

Furthermore, the invention provides a method of powder coating a surface. A dry powder paint doped with nanostrands is obtained. The surface and the nanostrand doped powder paint are oppositely charged with respect to one another. The nanostrand doped powder paint is applied to the surface. This can be done by spraying, brushing or other suitable approach. The paint is cured in an oven causing the paint to mold into a solid layer.

In addition, a urethane-based nickel nanostrand coating can provide an electrostatic discharge that provides a chemical-resistant coating to metals, composites, plastics, etc. For example, nickel nanostrands can be added to rubber, elastomer or silicone to convert sonic/mechanical energy to heat, or to form a sensor.

In addition, an electromagnetic isolation (EMI) seal for enclosures containing sensitive electronics or systems can be provided. Nickel nanostrands can be added to rubber or silicone to form the seal, such as between sections, or around access doors.

In addition, a carbon fiber composite with a nickel nanostrand-doped epoxy resin can be provided. The nickel nanostrands can be dispersed in the epoxy resin and then applied to the fiber, such as by wet winding (of fiber bundles called "rovings" and/or "tows") or by immersion or coating of woven fabrics or unidirectional tapes, such as in the production of "pre-preg" materials. The nickel nanostrands can form a web of interconnected filaments that extend through the epoxy resin to the carbon filaments, thus interconnecting carbon filaments. In another aspect, the composite material can be formed into conductive panels or pipes. The inherent resistivity of the composite can be controlled by the amount of nanostrands. Applying a current to the pipe can heat the pipe, to maintain a temperature, or to facilitate improved flow through the pipe. In another aspect, an inner and/or an outer layer of non-conductive composite can be disposed on the pipe to insulate the flowing fluid and/or the exterior of the pipe. In another aspect, the composite can be formed with multiple layers with selectively conductive layers. For example, a conductive layer can be disposed between non-conductive layers. The layers can be configured as various items or objects. For example, the layers can be configured as a tank. The volume of the tank can change the capacitance of the entire structure. Thus, the tank itself can act as an integrated level sensor. In another aspect, the conductive layer(s) embedded in a pipe wall could serve as a simple wet/dry sensor, or be calibrated to provide flow characteristics, temperature, or pressures within an entire pipe spool, without the need for conventional sensors requiring extra penetrations or ports.

In another aspect, the nickel nanostrand/doped-resin composite can include a polymer coating. The polymer coating can include nickel nanostrands as described above, or another metallic material, such as titanium, chromium, copper, molybdenum, silver, tungsten, platinum and gold and/or related alloys fibers.

In addition, a composite with multiple layers, such as a fiber epoxy composite embedding a polymer based nickel nanostrand layer, can be provided. Thus, a conductive layer can be insulated between non-conductive layers.

In addition, a method for determining structural health of a laminate structure by testing the conductivity across the laminate can be provided. In another aspect, a location of damage can be determined by testing the conductivity of the laminate at a plurality of locations/orientations. The laminate structure can have nickel nanostrands dispersed through the epoxy resin as described above. Alternatively, a current or voltage can be applied to a polymer-based nickel nanostrand coating or laminate to cause resistive heating and a thermal signature that can be analyzed to check for defects or anomalies. In one alternative, the laminate structure can be tested at multiple time intervals to identify structural deterioration (e.g. monthly or yearly testing).

In addition, a tough, protective conductive substrate for electroplating parts and assemblies, whether conductive or non-conductive, can be provided. For example, a polymer-based nickel nanostrand coating can replace a traditional copper-strike prior to electroplating a metallic layer on an aircraft exterior panel, leading and trailing edges.

In addition, a method for resin transfer molding of composite panels requiring improved toughness can be provided by supplementing conventional toughening particles (usually rubber) with nickel nanostrands. The nickel nanostrands and/or toughenening particles can be applied to dry fiber forms before resin transfer molding. The nickel nanostrands can be dispersed through a solvent and sprayed onto fiberglass, carbon or other cloth, which loads the otherwise non-conductive cloth with conductive nanostrands and/or toughening particles. The cloth can be made tacky (for better handling) by the addition of a tackifier, such as a diluted resin. After the solvent is flashed off, the cloth is trapped in the mold and infused with resin. Such a method provides nickel nanostrands and/or toughening particles throughout the composite, with the nanostrands being more evenly dispersed in the epoxy resin or a polymer coating than is achievable with conventional molding.

Various aspects of nickel-nanostrands are disclosed in US Patent Publication No. 2009-0117269 and U.S. Pat. Nos. 5,967,400; 5,951,791; and 5,130,204; which are herein incorporated by reference.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A low radar cross-section structure, comprising:

a substrate configured to have a low radar cross-section or signature, including a radar absorbing material, a multi-layer laminate, a rubber material, alternating layers of dielectric material, a layer of hexagonal honeycomb tubes, a radar ablative paint, two layers of ferrite material separated by a dielectric, or combinations thereof; and a polymer-based nickel nanostrand coating in combination with the substrate, the coating including nickel nanostrands dispersed within a polymer.

2. A structure in accordance with claim 1, wherein the polymer-based nickel nanostrand coating includes a silicon based resin.

3. A structure in accordance with claim 1, wherein the polymer-based nickel nanostrand coating is disposed over the substrate.

4. A structure in accordance with claim 3, wherein the coating further comprising:

a pigment that is conductive or semi-conductive.

5. A structure in accordance with claim 3, wherein the coating further comprising:

an abrasion resistant material.

6. A structure in accordance with claim 3, wherein the coating further comprising:

a biocide.

7. A structure in accordance with claim 1, wherein the polymer-based nickel nanostrand coating is disposed within the substrate.

8. A structure in accordance with claim 1 in combination with a vehicle, wherein the substrate and coating are disposed on the vehicle.

9. A polymer-based coating, comprising:

a polymer;

nickel nano strands dispersed within the polymer; and a pigment that is conductive or semi-conductive dispersed in the polymer; and a wrap comprising a plastic sheet or film with an adhesive and with the polymer with the nickel nanostrands and pigment therein applied to a surface of the plastic sheet.

10. A coating in accordance with claim 9, wherein the polymer includes a silicon based resin.

11. A coating in accordance with claim 9, wherein the pigment includes carbon black, silver, iron oxide, flake mica, titania, or combinations thereof.

12. A coating in accordance with claim 9, further comprising:

an abrasion resistant material dispersed in the polymer.

13. A coating in accordance with claim 9, further comprising:

a biocide dispersed in the polymer.

14. A coating in accordance with claim 9, wherein the plastic sheet or film is conductive or semi-conductive.

15. A coating in accordance with claim 9 in combination with a vehicle, wherein the plastic sheet or film is a wrap wrapped about and adhesively applied to the vehicle.

16. A polymer-based coating comprising nickel nanostrands and a pigment that is conductive or semi-conductive dispersed within a polymer, in combination with a coating kit comprising:

a) a first "A" component with the nickel nanostrands and the pigment pre-dispersed in a resin and packaged together; and b) a second "B" component or catalyst separately packaged from the first "A" component and combinable with the first "A" component immediately prior to use.

17. The coating in combination with the coating kit of claim 16, further comprising:

one or more additives including a biocide, an abrasion resistant material, grit, or combinations thereof.

18. A coating in accordance with claim 16, wherein the polymer includes a silicon based resin.

19. A coating in accordance with claim 16, wherein the pigment includes carbon black, silver, iron oxide, flake mica, titania, or combinations thereof.

20. A field configurable coating kit, comprising:

a) a first "A" component of nickel nanostrands pre-dispersed in a resin with silicon and packaged together;

b) a second "B" component or catalyst separately packaged from the first "A" component and combinable with the first "A" component immediately prior to use; and c) one or more additives including a biocide, a pigment, an abrasion resistant material, grit, or combinations thereof.

21. An electromagnetic isolation (EMI) wrap in combination with a vehicle, comprising:

a) a plastic sheet or film with an adhesive;

b) nanostrands dispersed in a polymer applied to a surface of the plastic sheet or film; and c) the plastic sheet or film is wrapped about and adhesively applied to the vehicle.

22. A wrap in accordance with claim 21, wherein the plastic sheet or film is conductive or semi-conductive.

23. A method of powder coating a surface, comprising:

obtaining a dry powder paint doped with nickel nanostrands;

oppositely charging the surface and the nanostrand doped powder paint with respect to one another;

applying the nanostrand doped powder paint to the surface; and curing the paint in an oven causing the paint to mold into a solid layer.

* * * * *